US008578997B2

(12) United States Patent
Rauch

(10) Patent No.: US 8,578,997 B2
(45) Date of Patent: Nov. 12, 2013

(54) TIGHTENING STRAP DEVICE FOR A HEAT-WELDABLE PLASTIC STRIP

(75) Inventor: Manfred Rauch, Sasbach (DE)

(73) Assignee: Fromm Holding AG, Cham (CH)

( * ) Notice: Subject to any disclaimer, the term of this patent is extended or adjusted under 35 U.S.C. 154(b) by 0 days.

(21) Appl. No.: 13/421,605

(22) Filed: Mar. 15, 2012

(65) Prior Publication Data

US 2012/0247684 A1 Oct. 4, 2012

Related U.S. Application Data

(63) Continuation of application No. PCT/EP2010/005680, filed on Sep. 16, 2010.

(30) Foreign Application Priority Data

Sep. 17, 2009 (DE) ..... 10 2009 041 608

(51) Int. Cl.
*B32B 37/00* (2006.01)

(52) U.S. Cl.
USPC ..... 156/494; 156/73.5; 156/510; 156/580; 100/33 PB

(58) Field of Classification Search
USPC ..... 156/73.5, 229, 494, 495, 580, 510, 530; 100/29, 32, 33 PB
See application file for complete search history.

(56) References Cited

U.S. PATENT DOCUMENTS 5,306,383 A 4/1994 Kobiella
5,954,899 A * 9/1999 Figiel et al. ..... 156/73.5
6,328,087 B1 * 12/2001 Finzo et al. ..... 156/494

FOREIGN PATENT DOCUMENTS

EP 0 949 146 A1 10/1999
EP 0 999 132 A1 5/2000

OTHER PUBLICATIONS

PCT International Search Report mailed Apr. 15, 2011 in a related PCT International Application No. PCT/EP2010/005680 (8 pages).
PCT Written Opinion mailed Apr. 15, 2011 in a related PCT International Application No. PCT/EP2010/005680 (6 pages).

* cited by examiner

*Primary Examiner* — James Sells
(74) *Attorney, Agent, or Firm* — Robert P. Michal; Lucas & Mercanti, LLP

(57) ABSTRACT

The invention relates to a tightening strap device for a heat-weldable plastic strip that is used to strap a packaged item and that is joined at a welding point to form a loop. Whereas in prior art the plastic strip is held during welding by several clamping elements, in the present invention the welding plate functions simultaneously as a clamping element.

7 Claims, 5 Drawing Sheets

TIGHTENING STRAP DEVICE FOR A HEAT-WELDABLE PLASTIC STRIP

This is a Continuation of PCT International Application PCT/EP2010/005680 filed Sep. 16, 2010, which in turn claims benefit to German Patent Application No. 10 2009 041 608.0 filed Sep. 17, 2009, the entire disclosure of each of which is incorporated herein by reference.

The invention relates to a tightening strap device for strapping a package with a heat-weldable plastic strip which is placed around it and forms a lower strip and an upper strip at a welding point, and having a housing and a device for clamping the plastic strip, and having a welding plate which vibrates with respect to the housing in order to weld the plastic strip.

An apparatus of this type is known, for example, from EP 0 949 146. The plastic strip is placed in a loop around a package, a first, free end of the plastic strip forming a lower strip at a welding point and the other end of the plastic strip, as upper strip, being guided through together with the lower strip under a welding plate after formation of the loop at the welding point. The upper strip is then gripped by way of a friction wheel or a similar element, and the loop is tightened around the package.

In order that the lower strip is not pulled out of the region of the welding point during this tightening, a clamping apparatus is provided, by way of which said lower strip is fixed. Said clamping device is usually arranged in such a way that that section of the plastic strip which is free of tensile force, lies in front of the clamping apparatus in the direction of tensile force and is adjacent to the free end of the plastic strip is guided through the welding point.

At the other end of the loop, that end of the plastic strip which is loaded with tensile force is then guided as upper strip over the free end of the plastic strip as lower strip. In the known apparatus, in this region, the lower strip which is free of tensile force on account of the clamping apparatus and the upper strip which is loaded with tensile force on account, for example, of a friction wheel are then pressed together firmly by a further clamping device.

The plastic strip is therefore wound tightly around the package and is pressed together in this state at a point, at which the lower strip and upper strip run parallel to one another. In this case, the upper strip is substantially clamped. The lower strip is already held by the lower strip clamp. The abovementioned friction wheel is arranged downstream of this clamping point of the upper and lower strips in the direction of tensile force. If the frictional and tensile force is then no longer applied to the plastic strip by the friction wheel, the upper strip is also free of tensile force in the region which is arranged downstream of the clamping point in the direction of tensile force.

A welding plate is then lowered at the welding point onto said upper strip which is free of tensile force, and said welding plate is vibrated with respect to the housing of the tightening strap device. Here, a toothing system which transmits the vibrations of the welding plate to the upper strip of the plastic strip is provided between the welding plate and the upper strip of the plastic strip. The upper strip is therefore also imparted with a corresponding vibration.

At the same time, the welding plate presses the upper strip against the lower strip, with the result that a relative movement between the upper strip and the lower strip occurs on account of the vibration of the welding plate and the upper strip, which relative movement leads to local melting of the heat-weldable plastic strip on account of the friction which is produced in the process.

After ending of the vibration movement and a brief time period of cooling, the upper strip and lower strip are then welded to one another at the welding point. The clamping apparatuses which are present on both sides of the welding point for the lower strip or for the upper and lower strips can then be opened.

It is a disadvantage of the previously described method that the control of the individual clamping and welding elements is relatively complex and therefore a high outlay is to be made in terms of control technology.

It is therefore an object of the present invention to simplify an apparatus of the above-described type, in such a way that it is structurally simpler and therefore both can be produced more easily and can be operated more easily.

According to the invention, this object is achieved by virtue of the fact that, in the direction of the plastic strip, the already known welding plate is given a tensile force support with respect to the housing.

The advantage of this invention lies in the fact that, on account of this tensile force support, the above-described clamping apparatus for the upper strip can be omitted, which clamping apparatus is normally arranged immediately adjacently to the welding point. The tightening strap device according to the invention can therefore also be of shorter design in the adjacent region to the package. Relatively small packages or packages with relatively small diameters can therefore also be strapped.

In particular, an apparatus of this type can also perform the previously separate functions of welding plate and clamping element by way of merely one component. Contrary to previous constructions, it is now possible on account of the development according to the invention to use the welding plate at the same time as clamping element, in order to use it to fix tensile forces which act on the plastic strip.

In one particularly preferred embodiment of the invention, the tensile force support for the welding plate is provided with an antifriction bearing which acts on the welding plate. As a result, in particular, short force introduction paths are possible, with the result that long force introduction paths are avoided which would make a correspondingly high moment support necessary.

It has proved particularly advantageous to provide the welding plate with a toothing system which acts in the direction of tensile force of the plastic strip. As a result, it is possible to keep the actual welding point on the plastic strip free of tensile forces as previously. Instead, the corresponding tensile forces which act in the plastic strip during tightening of the loop are transmitted directly to the welding plate via the toothing system on the upper side of the upper strip which extends in the region of the welding point. The underside of the upper strip which passes through below the welding plate, where the welding point also is, is therefore free of force.

On account of the embodiment according to the invention, there is therefore only one device for clamping the plastic strip, and said device acts on the lower strip. Instead of by a clamping apparatus which has previously been provided for this purpose, the upper strip is fixed in the strip direction by the welding plate.

In particular, in order to achieve particularly short force introduction paths, it is also proposed to integrate the tensile force support of the welding plate into a ram which can be raised up from the plastic strip within the housing and can be lowered in the direction of said plastic strip. Whereas said ram is of relatively rigid and therefore solid configuration, the welding plate can continue to be of relatively delicate configuration, with the result that only low inertial masses have to be moved during its vibration movement. A smaller and therefore lighter motor can therefore also be used for the drive of the vibration plate than if the ram were also moved. Since the tightening strap devices according to the invention are usually manually handled apparatuses, a corresponding weight saving is of advantage.

In order that, during raising and lowering of the ram, the welding plate is fixed with respect to said ram, it is proposed to allow the tensile force support to act on one side of the welding plate and to provide a holding element on the opposite side, which holding element, together with the tensile force support, fixes the welding plate in an axial direction of the ram.

Embodiments which are particularly small and therefore of compact design are possible by way of a corresponding construction. Here, it is proposed, in particular, to implement the holding element, just like the tensile force support, with rolling elements, which can assume not only a pure supporting function. Rather, the corresponding rolling elements can also transmit transverse forces if guided in corresponding rolling tracks. This is sufficient to hold the welding plate, for example, within a ram.

The contact pressures to be transmitted between ram and welding plate are preferably transmitted, however, via antifriction bearings which are oriented in the direction of the contact pressure. The antifriction bearings which are provided for the tensile force support and the holding element for the welding plate can therefore be kept free of corresponding loads from contact pressures of this type.

The ram, in which the welding plate is held, can either itself be seated in a corresponding guide on the housing or else can also transmit forces to the housing by a supporting arm or the like.

It is still to be mentioned that the ram can also carry a blade which is, in particular, sprung, acts on the upper strip, and by way of which, during the welding operation, the end which lies opposite the free end of the plastic strip is severed, with the result that the welding point then connects two free ends of a loop made from heat-weldable plastic strip to one another.

Further advantages and features of the invention result from the following description of one exemplary embodiment. In the drawing.

Figure 1:
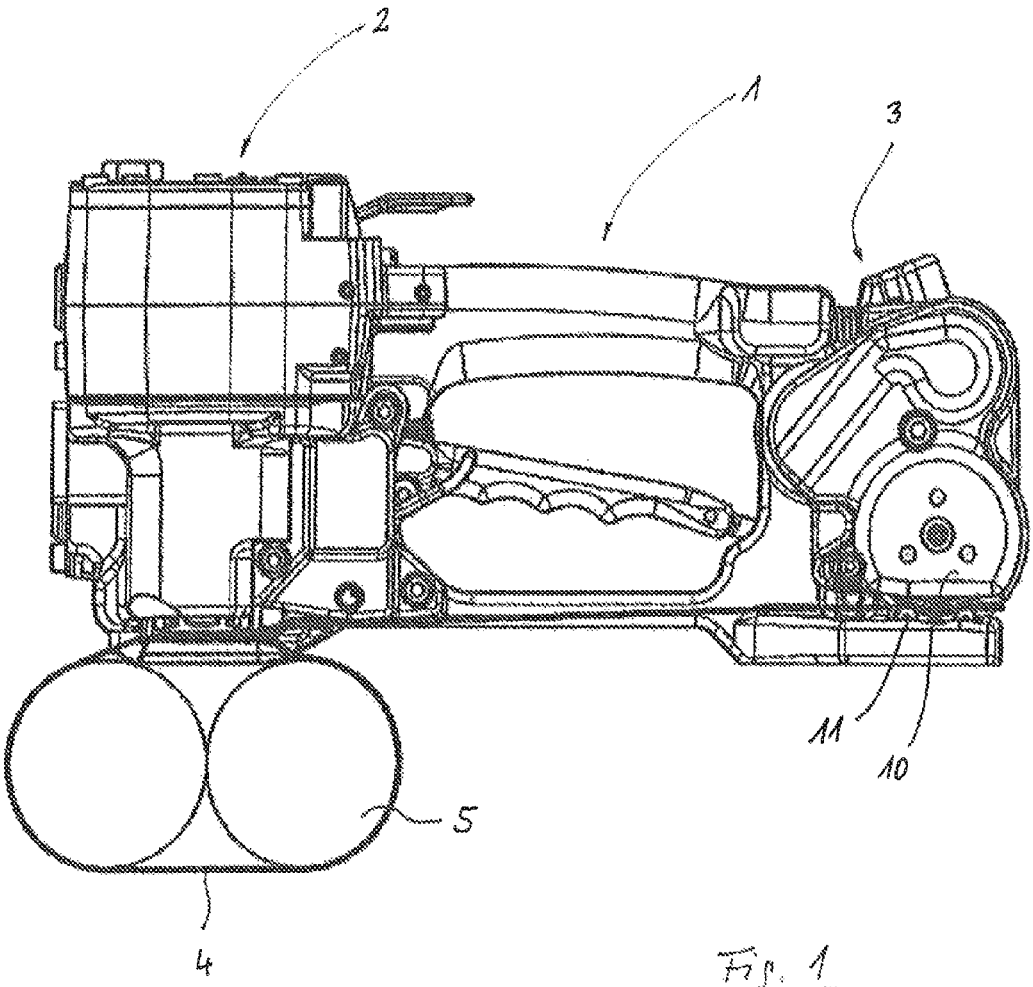
FIG. 1 shows a side view of a tightening strap device.

In FIG. 1, the side view of a tightening strap device is seen. Said tightening strap device has a grip region 1 which is arranged between a welding section 2 and a clamping section 3.

It is also possible to arrange the clamping section and the welding section on the same side of the grip region and not on opposite sides as in the example which is shown here. The embodiment which is described here has the advantage of having a more balanced mass distribution, which improves the ability to handle the tightening strap device.

A package 5 is strapped with a plastic strip 4 by way of a tightening strap device of this type. In the example which is shown here, the package 5 consists of two cylindrical elements. However, it is also possible to strap plates or plate stacks, angular bars or the like here.

Figure 2:
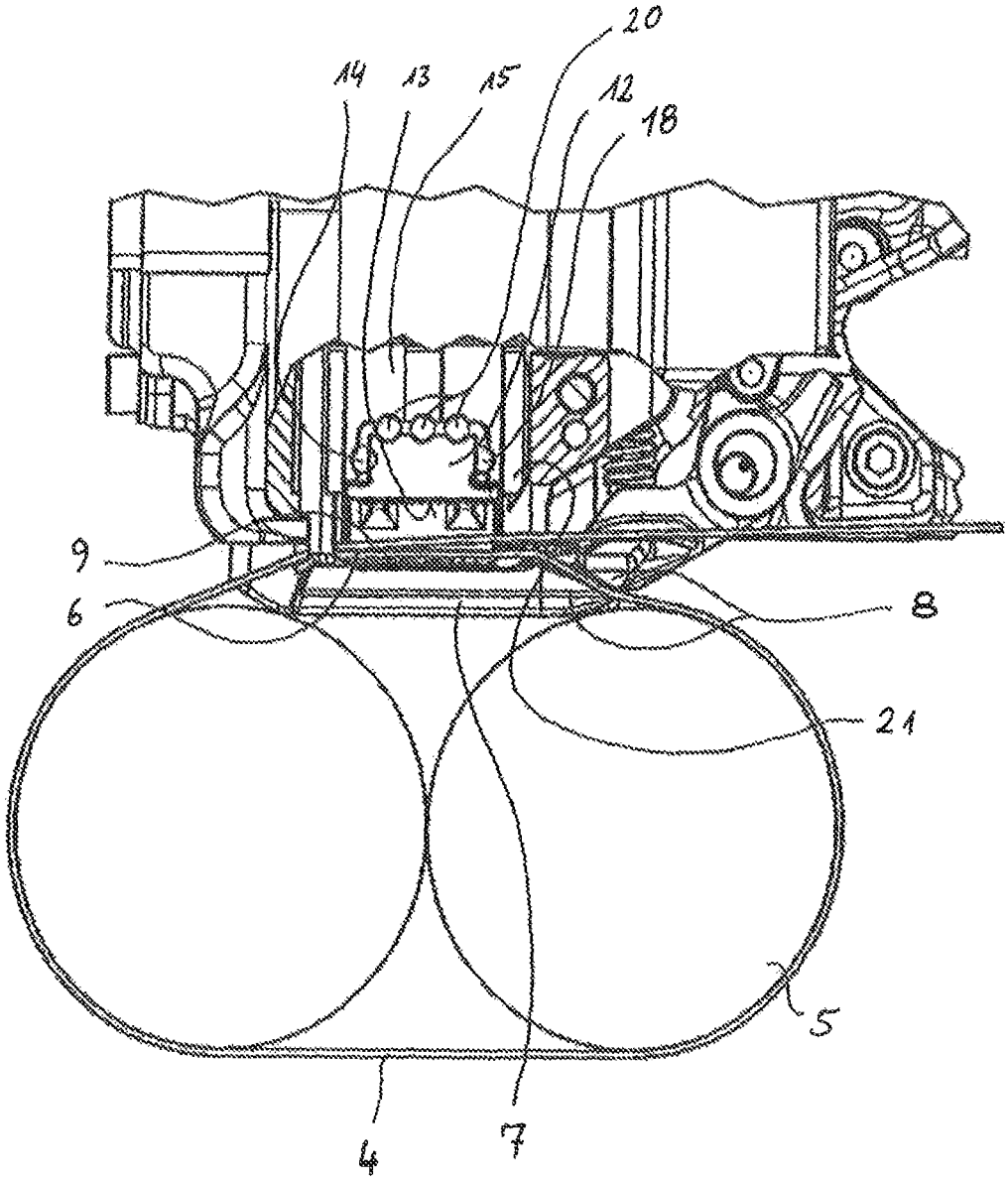
FIG. 2 shows a detailed view of an assembly of a tightening strap device according to FIG. 1.

The plastic strip 4 is guided around the package 5 and subsequently threaded into a tightening strap device; as can be seen in FIG. 2, it is placed with a free end 6 over a base plate 7 of the tightening strap device. It is gripped by a clamping apparatus 8 and fixed in the region where the plastic strip 4 runs off from the base plate 7 as lower strip.

Moreover, the plastic strip 4 which is guided in a loop is guided a second time over the base plate 7 with a section which lies downstream of the guiding around the package 5 in the strip direction. Here, that section of the plastic strip 4 which is guided over the base plate 7 again after being guided around the package 5 forms an upper strip 9.

The plastic strip which runs further as upper strip 9 is then guided to the clamping section 3 (cf. FIG. 1) and is routed under a friction wheel 10 there. The friction wheel 10 presses the plastic strip 4 against a sliding element 11 and therefore tightens the plastic strip 4. The tensile force runs along the plastic strip 4 around the package 5 and is routed out of the plastic strip 4 again at the clamping apparatus 8.

In the region above the base plate 7, the lower strip 6 is therefore free of tensile force, whereas the upper strip 9 absorbs tensile force.

After the friction wheel 10 has clamped the plastic strip 4 correspondingly, a welding plate 12 is lowered onto the upper strip 9 and pressed against the latter in the region of the base plate 7.

Here, the welding plate 12 is provided with a toothing system 13 on its side which faces the upper strip. A partially positive, partially nonpositive connection of the welding plate 12 and the upper strip 9 is achieved by way of said toothing system 13.

At the same time, the clamping force at the friction wheel 10 is released, in order to avoid splitting of the upper strip 9 during the welding and cutting operation.

Moreover, at the same time the welding plate 12 is imparted with a vibration, the vibrational direction of which extends transversely with respect to the longitudinal axis of the strip but parallel to its surface orientation.

As a result of this vibration, the upper strip 9 is moved to and fro with respect to the lower strip 6. Here, friction occurs between the underside of the upper strip 9 and the upper side of the lower strip 6, which friction leads there in each case to local melting of the plastic strip. In this way, the upper strip 9 and the lower strip 6 are welded to one another via friction welding in the region between the base plate 7 and the welding plate 12.

In the example which is shown here, the welding plate 12 is provided with an antifriction bearing 14 on its side which lies on the left in FIG. 2. In the example which is shown here, said antifriction bearing 14 is configured in such a way that exclusively forces are guided via it which are directed substantially parallel to the course of the upper strip 9 and the lower strip 6.

In this way, the welding plate 12 is provided with a tensile force support. The welding plate 12 can therefore absorb the stresses which occur in the plastic strip 4 in the region of the loop around the package 5 and the tensile forces which result herefrom, via the toothing system 13 which is present on its underside. Said tensile forces are then conducted indirectly or directly into the housing of the tightening strap device. It is to be noted here that, in the present case, a housing is also to be understood as a frame or the like which lies on the inside and on which individual modules or components are supported positively and/or nonpositively or are correspondingly fastened or fixed to said frame.

In the present case, the welding plate 12 is mounted in a ram 15 which can be displaced in a guide within the housing of the tightening strap device, with the result that the welding plate 12 can be raised or lowered. Via said guide of the ram 15, tensile forces which are introduced into the ram 15 by the welding plate 12 are forwarded to the housing of the tightening strap device.

Figure 4:
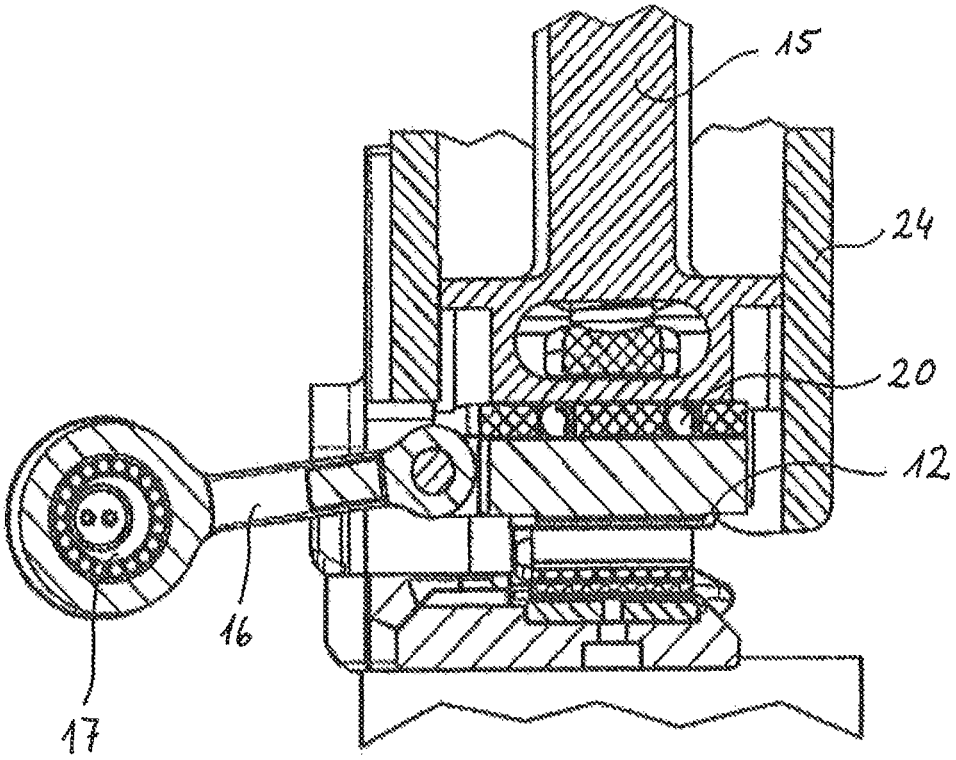
FIG. 4 shows a sectional view of an assembly according to FIG. 2.

Via said ram 15, a pressing force is exerted on the welding plate 12, whereas, as can be seen in FIG. 4, the welding plate 12 is imparted with a vibration via a swinging arm 12. FIG. 4 shows the welding plate 12 in the raised position.

Here, the swinging arm 16 connects the welding plate 12 to an eccentric drive 17, via which the vibration movement is generated.

In order that the welding plate 12 does not fall out of the ram 15 when the latter is raised, a holding element 18 is provided on the welding plate 12 opposite the antifriction bearing 14 in the embodiment which is shown here, which holding element 18 is likewise a rolling element and is guided in corresponding rolling tracks on the ram 15 and/or on the welding plate 12. Together with the antifriction bearing 14, said holding element 18 brings about axial securing of the welding plate 12 within the ram 15.

In order to absorb the contact pressures to be transmitted between the ram 15 and the welding plate 12, an antifriction bearing 20 is likewise provided, in which the rolling bodies run in rolling tracks which are provided on the underside of the ram 15 and on the upper side of the welding plate 12.

On account of this antifriction bearing 20, the antifriction bearings 14 and 18 which are provided laterally of the welding plate 12 are free of transverse force. This is advantageous for their low wear.

A dividing knife 21 which is mounted in a sprung manner is also provided on the ram 15 adjacently to the welding plate 12. Said dividing knife 21 is lowered with the ram 15 during the welding operation and the upper strip is then severed as a result of the vibration movement of the upper strip 9 under said dividing knife 21.

Figure 3:
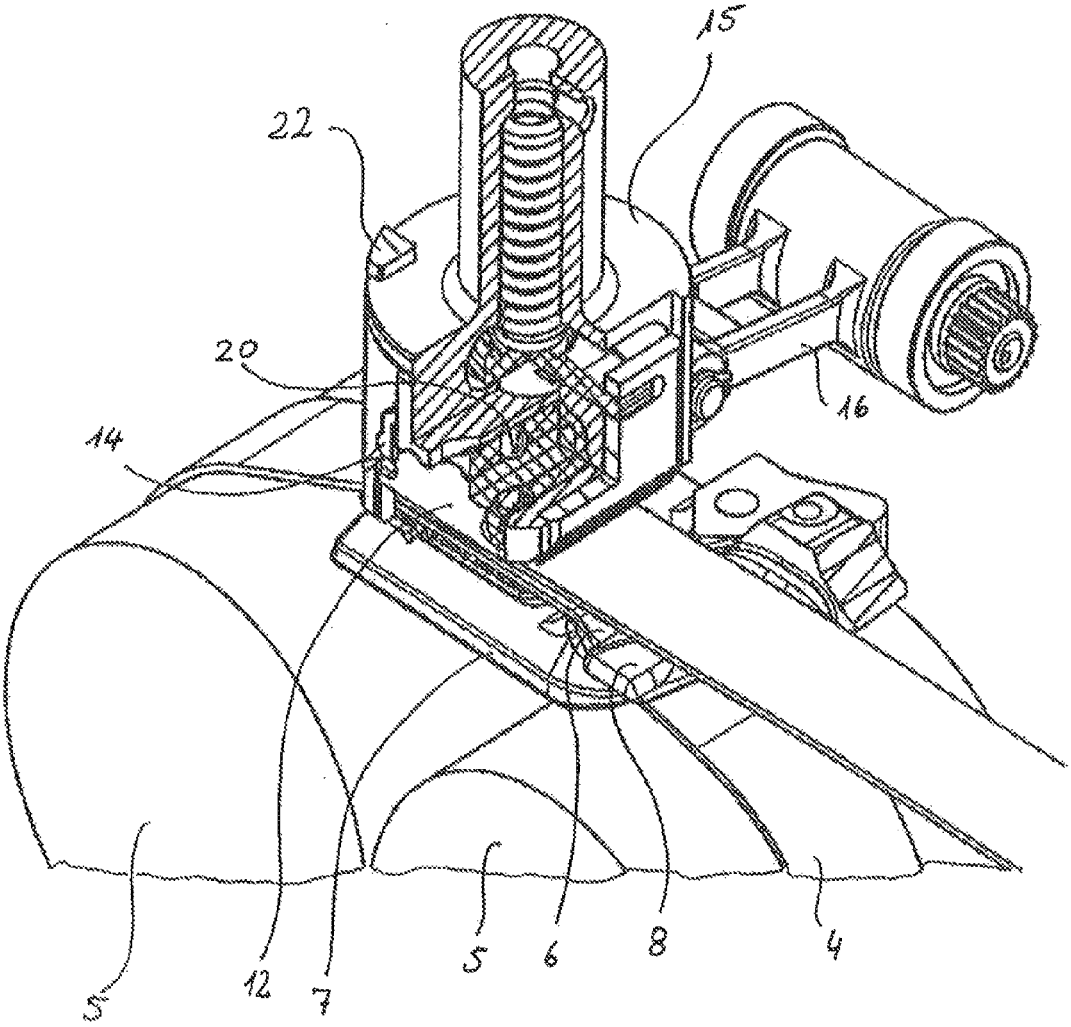
FIG. 3 shows a perspective view of an assembly according to FIG. 2.

FIG. 3 shows a perspective view of the previously described elements which are shown in sections in FIGS. 2 and 4. The packages 5 can be seen which are strapped with the plastic strip 4. Here, the free end of the plastic strip 4 is gripped as lower strip 6 by the clamping apparatus 8.

The lower strip then runs together with the upper strip 9 over the base plate 7 and is imparted with a vibration there by the welding plate 12. Here, the welding plate 12 is guided in a ram 15 and is moved to and fro in the latter by a swinging arm 16.

Here, the welding plate 12 is secured against falling out of the ram 15 via a holding element 18 which is configured as an antifriction bearing, together with an antifriction bearing 14 which also acts as a tensile force support. Here, the pressing forces which are transmitted from the ram 15 to the welding plate 12 are transmitted via an antifriction bearing 20.

Furthermore, a strip guide 22 which can be lowered with or in the ram 15 can be seen in FIG. 3 on said ram 15. Here, a further strip guide which cannot be seen in FIG. 3 is provided on the ram 15 on the other side of the strip 4.

By way of said strip guides, the plastic strip 4 is adjusted at the point, at which it runs under the ram 15, in order that the upper and lower strips lie exactly above one another. Correct welding and correct severing of the upper strip are therefore possible.

As soon as the ram 15 has been lowered, the strip guides 22 are raised, in order that the upper strip 9 can be vibrated in an unimpeded manner.

Figure 5:
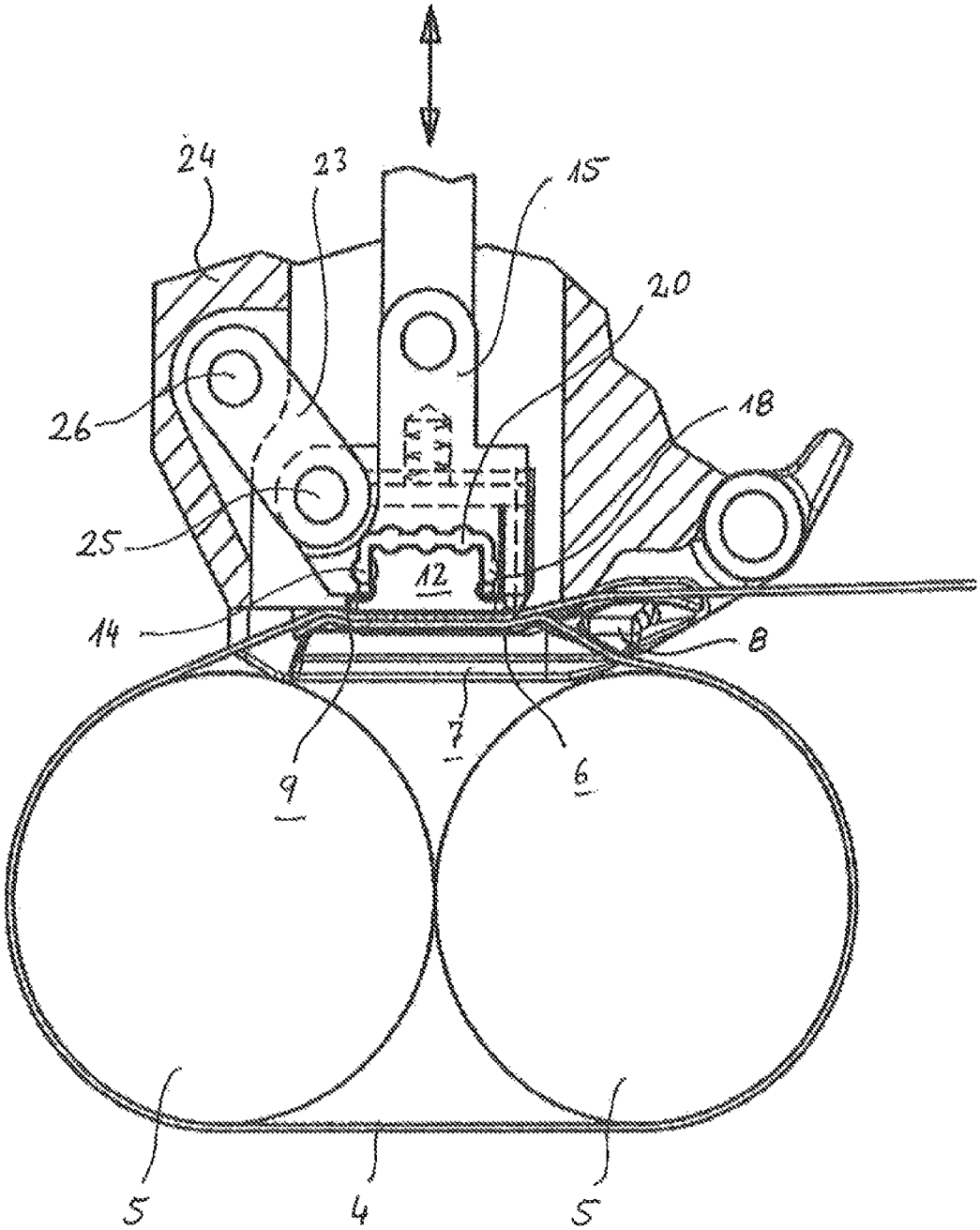
FIG. 5 shows an alternative embodiment of an assembly according to FIG. 2.

FIG. 5 shows another alternative embodiment for a ram. Here, identical parts are provided with identical designations.

Whereas, in the previously described embodiment, the ram 15 is guided via a positively locking sleeve-like guide within the housing of a tightening strap device, FIG. 5 proposes a support of the ram 15 via a supporting arm 23. Via said supporting arm 23, the tensile forces which are guided from the upper strip 9 onto the welding plate 12 by the antifriction bearing 14 into the ram 15 are introduced into the housing 24 of the tightening strap device and are therefore supported. Here, the supporting arm 23 is connected via corresponding pins 25 and 26 to the ram 15 or else the housing 24.

The invention claimed is:

1. A strap tightening device for securing a heat-weldable plastic strip which is disposed around a package, the strap tightening device comprising a housing and a single clamping device which fixes the plastic strip, and a welding plate which vibrates with respect to the housing in order to weld the plastic strip, the welding plate comprising a tensile force support device which is disposed in a plane extending along a longitudinal direction of the plastic strip, wherein the welding plate is mounted in a ram which is moveable for selectable engagement with the plastic strip and wherein the tensile force support device acts on a first side of the welding plate and a holding element is provided on a second side of the welding plate opposite the first side, which holding element, together with the tensile force support device, holds the welding plate in the ram.

2. The strap tightening device as recited in claim 1, wherein the tensile force support device has an antifriction bearing.

3. The strap tightening device as recited in claim 1, wherein the welding plate has a toothing system which interacts with the plastic strap in a direction of tensile force of the plastic strip.

4. The strap tightening device as recited in claim 1, wherein the single clamping device which fixes the plastic strip acts on a first section of the plastic strip, which section acts as a lower strip, and a second section of the plastic strip, which section acts as an upper strip, is fixed in the longitudinal direction of the plastic by the welding plate.

5. The strap tightening device as recited in claim 1, further comprising an antifriction bearing operatively disposed between the ram and the welding plate, the antifriction bearing transmitting a contact pressure.

6. The strap tightening device as recited in claim 1, further comprising a supporting arm operatively disposed between the ram and the housing.

7. The strap tightening device as recited in claim 1, further comprising a blade which is operatively coupled to the ram.

* * * * *